US009180381B2

(12) United States Patent
O'Hare et al.

(10) Patent No.: US 9,180,381 B2
(45) Date of Patent: Nov. 10, 2015

(54) COLLAPSIBLE TOY APPARATUS

(71) Applicant: Mattel, Inc., El Segundo, CA (US)

(72) Inventors: Michael O'Hare, El Segundo, CA (US); Michael Strauss, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 279 days.

(21) Appl. No.: 13/896,898

(22) Filed: May 17, 2013

(65) Prior Publication Data

US 2013/0316613 A1 Nov. 28, 2013

Related U.S. Application Data

(60) Provisional application No. 61/651,918, filed on May 25, 2012.

(51) Int. Cl.
*A63H 33/00* (2006.01)
*A63H 33/18* (2006.01)
*A63H 33/42* (2006.01)

(52) U.S. Cl.
CPC ..... *A63H 33/00* (2013.01); *A63H 33/18* (2013.01); *A63H 33/42* (2013.01)

(58) Field of Classification Search
USPC ..... 446/4, 5, 6, 478, 487
See application file for complete search history.

(56) References Cited

U.S. PATENT DOCUMENTS

| | | | | |
|---|---|---|---|---|
| 276,539 | A | | 4/1883 | Reed |
| 2,338,803 | A | | 1/1944 | Donofrio |
| 2,385,724 | A | | 9/1945 | Olson |
| 2,702,191 | A | * | 2/1955 | Lemelson ..... 273/393 |
| 2,832,174 | A | | 4/1958 | Wing |
| 3,008,714 | A | * | 11/1961 | Pullen ..... 273/393 |
| 3,029,077 | A | * | 4/1962 | Benkoe ..... 273/380 |
| 3,565,425 | A | | 2/1971 | Breslow |
| 4,145,049 | A | | 3/1979 | Papazian |
| 4,319,751 | A | * | 3/1982 | Kurushima et al. ..... 273/440.1 |
| 4,578,291 | A | * | 3/1986 | Miner ..... 428/8 |
| 4,661,080 | A | * | 4/1987 | Goldstein et al. ..... 446/4 |
| 4,673,367 | A | * | 6/1987 | MacBain ..... 446/4 |
| 4,734,076 | A | * | 3/1988 | Goldstein et al. ..... 446/423 |
| 4,810,224 | A | * | 3/1989 | DeVincent ..... 446/230 |
| 4,844,474 | A | | 7/1989 | Schaub et al. |
| 4,867,723 | A | * | 9/1989 | Asbach ..... 446/4 |
| 4,979,926 | A | | 12/1990 | Bisceglia |
| 5,069,650 | A | * | 12/1991 | Lehmann et al. ..... 446/476 |
| 5,183,427 | A | * | 2/1993 | Draper ..... 446/4 |
| 5,234,216 | A | * | 8/1993 | Ostendorff ..... 273/127 A |
| 5,299,809 | A | | 4/1994 | Evangelista et al. |
| 5,334,073 | A | * | 8/1994 | Tilbor et al. ..... 446/308 |
| 5,360,365 | A | | 11/1994 | Evans |
| 5,397,260 | A | | 3/1995 | Tilbor et al. |
| 6,099,380 | A | * | 8/2000 | Rasmussen ..... 446/478 |
| 6,102,405 | A | | 8/2000 | Spikes |
| 6,135,851 | A | * | 10/2000 | Drake et al. ..... 446/487 |
| 6,325,692 | B1 | | 12/2001 | Webb |

(Continued)

*Primary Examiner* — Melba Bumgarner
*Assistant Examiner* — Joseph B Baldori
(74) *Attorney, Agent, or Firm* — The Mueller Law Office, P.C.

(57) ABSTRACT

A toy apparatus has a primary structure with components movably coupled together, and a target movably coupled to the primary structure. Repeated impacts on the target move the target from an initial position to a critical position. When the target reaches the critical position, the primary structure is released from a first state to a second state in which the components of the primary structure are at least partially displaced from each other.

18 Claims, 12 Drawing Sheets

(56) References Cited

U.S. PATENT DOCUMENTS

| | | | | |
|---|---|---|---|---|
| 6,672,659 | B1 * | 1/2004 | Melohn et al. | 297/118 |
| 6,964,593 | B1 * | 11/2005 | Stevens | 446/4 |
| 7,575,496 | B2 * | 8/2009 | Lau et al. | 446/4 |
| 7,594,844 | B2 * | 9/2009 | Cartlidge et al. | 446/148 |
| 8,137,151 | B2 * | 3/2012 | Kenney | 446/330 |
| 8,322,660 | B2 * | 12/2012 | O'Connor | 246/415 A |
| 2007/0072516 | A1 * | 3/2007 | Liff et al. | 446/478 |
| 2007/0293122 | A1 * | 12/2007 | O'Connor et al. | 446/429 |
| 2013/0316613 | A1 * | 11/2013 | O'Hare et al. | 446/487 |
| 2014/0073218 | A1 * | 3/2014 | Barthold et al. | 446/268 |
| 2014/0273707 | A1 * | 9/2014 | Becker et al. | 446/4 |

* cited by examiner

COLLAPSIBLE TOY APPARATUS

RELATED APPLICATIONS

This application claims priority to U.S. Provisional Patent Application No. 61/651,918 filed on May 25, 2012, and entitled "Collapsible Toy Apparatus," which is hereby incorporated by reference for all purposes.

BACKGROUND

Toy structures that are collapsible or destructible have long been a source of entertainment for children. For example, buildings and ships have been configured to break apart when a projectile impacts the object. The projectile, such as a toy missile or cannon, must hit a certain target area of the structure in order for the structure to be destroyed. The pieces of the structures are typically configured to instantly collapse or to be ejected to simulate an explosion when the target is hit.

Yet, there continues to be a need for new and creative ways to enhance the play value of such collapsible toys.

SUMMARY

In one embodiment, a toy apparatus has a primary structure with components movably coupled together, and a target movably coupled to the primary structure. Repeated impacts on the target move the target from an initial position to a critical position. When the target reaches the critical position, the primary structure is released from a first state to a second state in which the components of the primary structure are at least partially displaced from each other.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION

This disclosure relates to toy play structures that are collapsible or destructible when impacted by an object or external force. In various embodiments, a play structure undergoes repeated impacts to gradually move a component of the play structure toward a critical point, at which the entire structure is released to a secondary state. The gradual movement and repeated impacts add play value by, for example, increasing suspense and length of play.

Figure 1:
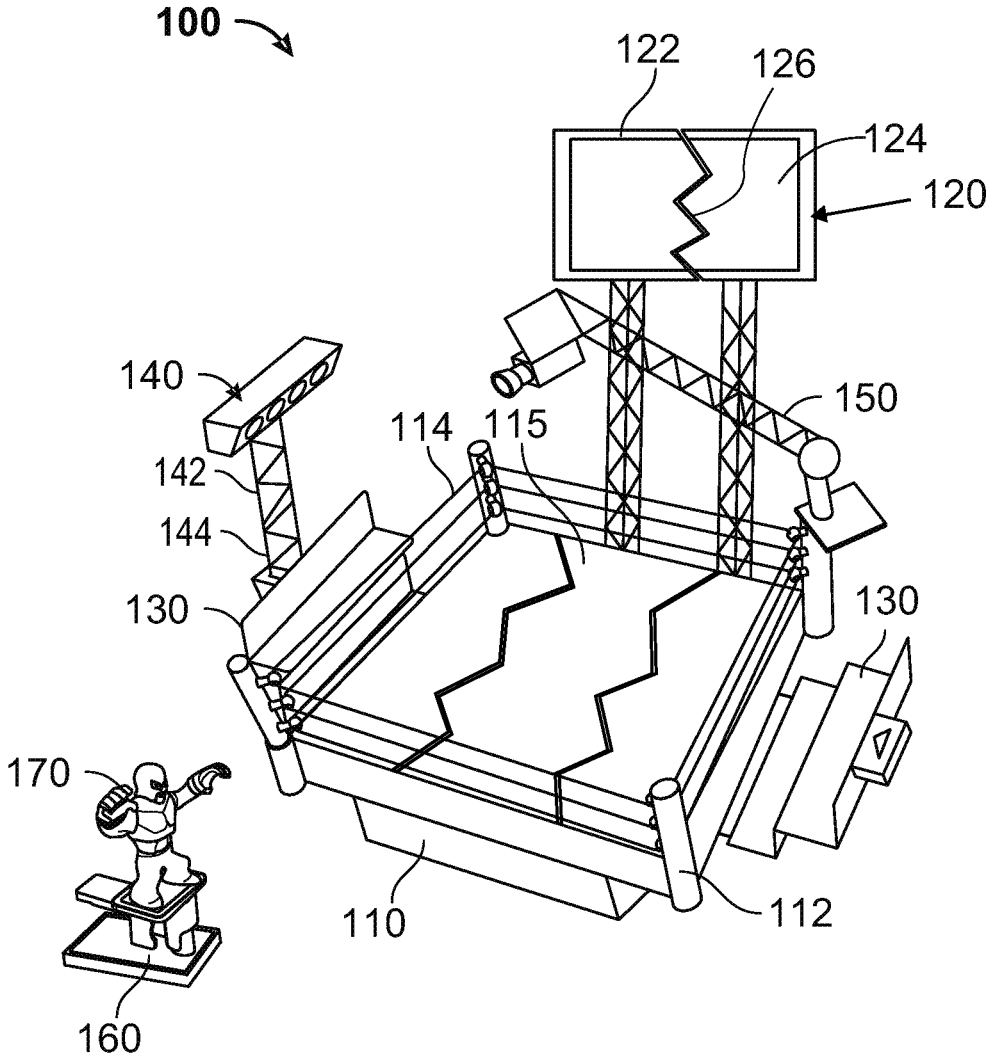
FIG. 1 is a perspective view of an exemplary toy stadium.

FIG. 1 illustrates an exemplary toy stadium 100, shown as a wrestling ring in this embodiment. In other embodiments, stadium 100 may be a primary structure of a different form, such as a theater, a shopping mall, or a school. Stadium 100 includes a wrestling ring 110 with floor 115, posts 112 with ropes 114 connecting them, a display screen 120, audience seating stands 130, a lighting structure 140, a camera crane 150, and a launching platform 160. One or more toy figures 170 may be placed in the wrestling ring 110, in the audience stands 130, and on the launching platform 160. Display screen 120 may be, for example, a simulated jumbotron or electronic billboard. In this embodiment, the screen 120 has a panel made of two pieces 122 and 124 that can break away from each other at line 126. Similarly, lighting structure 140 may have a support comprising an upper half 142 and a lower half 144 that are snap fit together. In other embodiments, the stadium 100 may include additional components (not shown) such as food vending stands, scoreboards, and surrounding wall structures. Toy stadium 100 in FIG. 1 is shown in an assembled state, in which, for example, the wrestling ring 110 has floor 115 intact, and display screen 120 is vertically upright.

Figure 2:
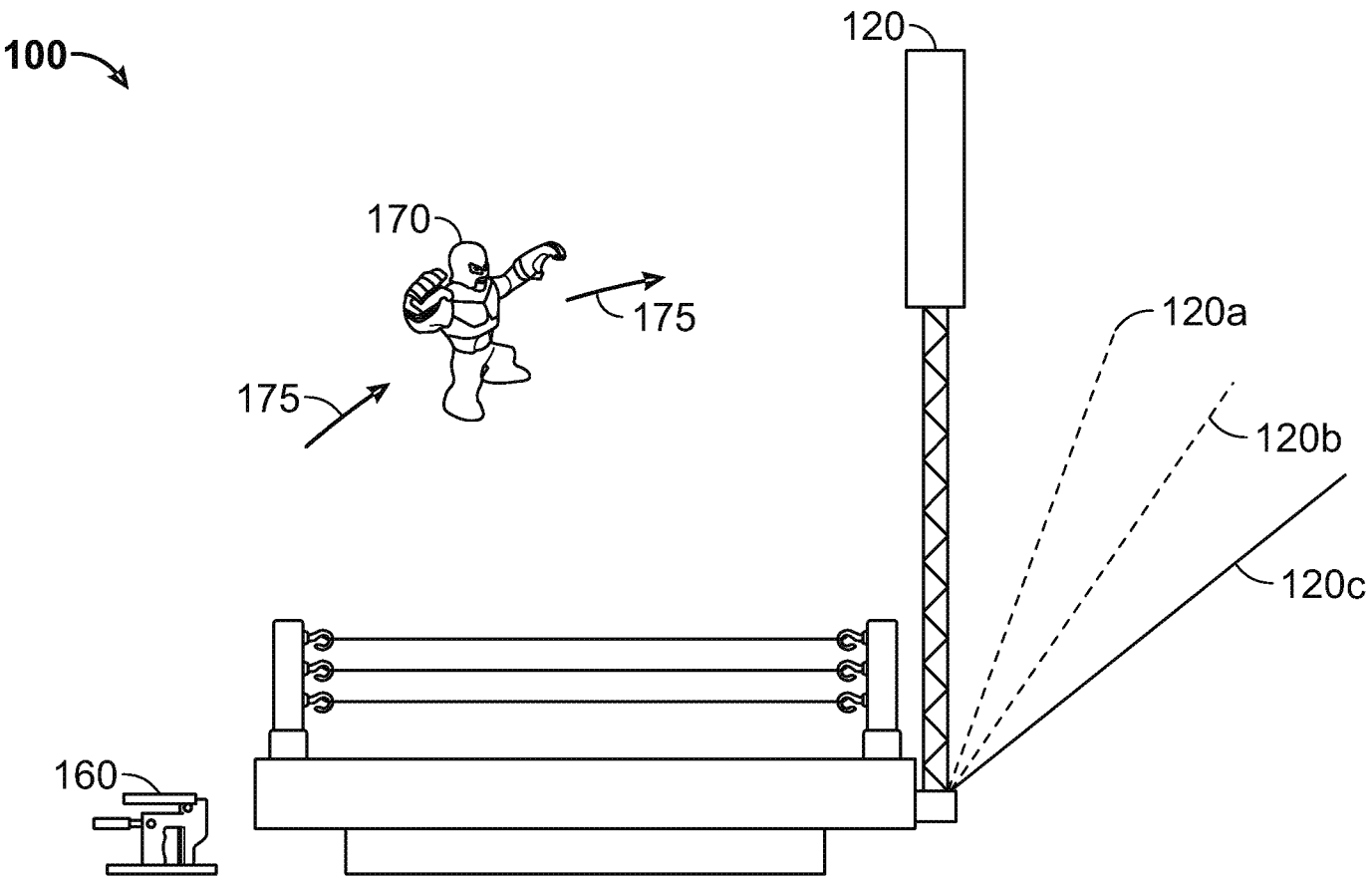
FIG. 2 is an illustration of various stages of the toy stadium of FIG. 1 during play.

Toy FIG. 170 is used as a projectile to be launched from launching platform 160 as indicated by arrows 175 in FIG. 2, in which it impacts display screen 120. An initial impact causes the screen 120 to tilt slightly to position 120*a*, while all other components of toy stadium 100 remain in their initial position. Repeated impacts on screen 120 from launching additional toy figures 170 causes the screen 120 to progressively tilt at larger and larger angles from its initial vertical position, such as to 120*b*. When the screen reaches a predetermined angle, such as 20-60 degrees from vertical as shown by critical position 120*c*, the various components of toy stadium 100 are released into a collapsed state. The various components of stadium 100—such as floor 115, audience stands 130, light structure 140, and camera crane 150—are movably coupled together so that advancing the screen 120 past the pre-determined or critical position 120*c* releases the other movable components of stadium 100 simultaneously. The number of impacts required to reach this pre-determined, critical position may range from one or more. That is, a first impact on the screen 120 will generally not cause the entire stadium to collapse, but the second or other subsequent impacts will trigger the stadium to convert from the assembled state to a collapsed state. The delayed destruction of stadium 100 brings a unique element of suspense and increased play value to the toy apparatus, as well as prolonged play time for the user.

Figure 3:
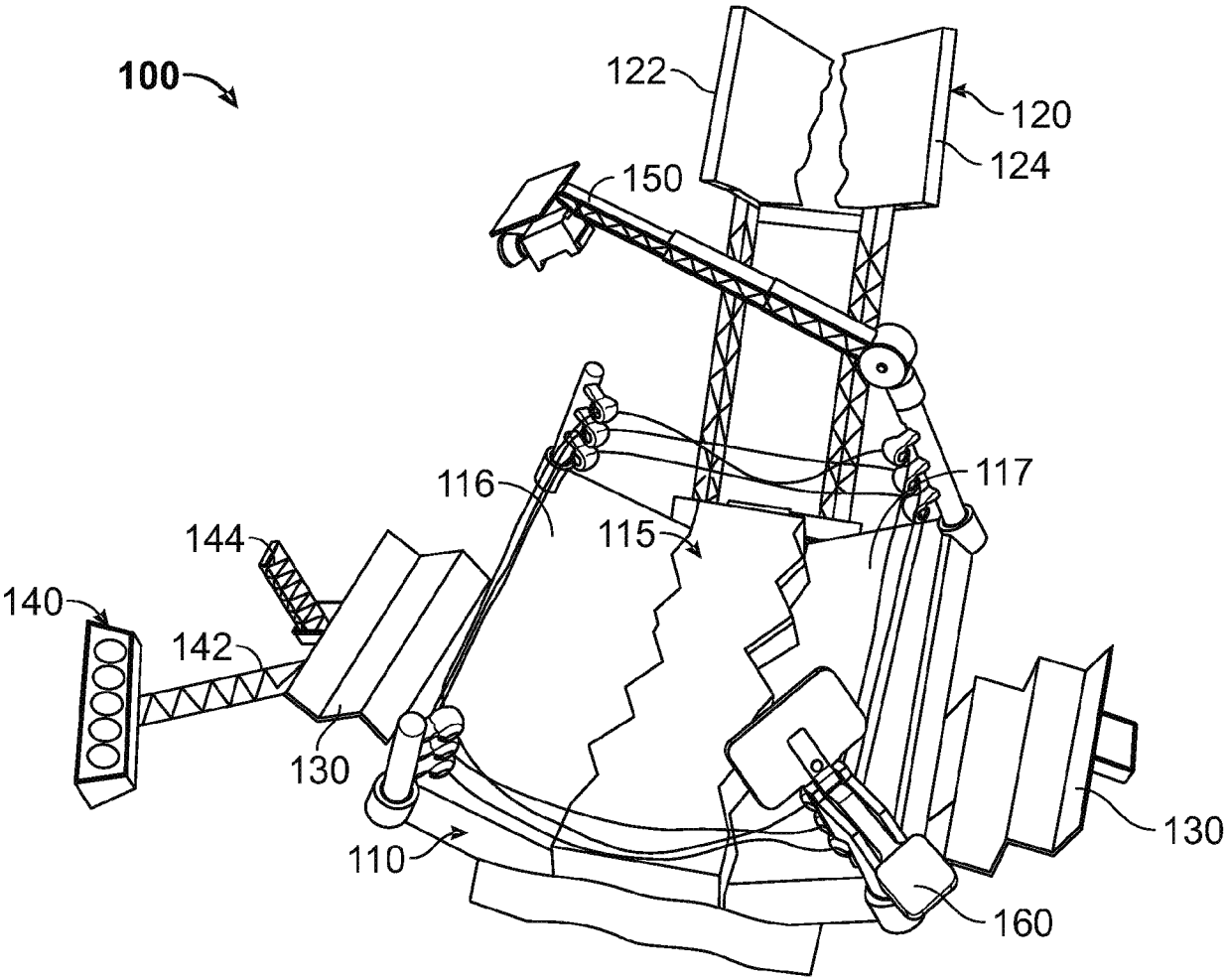
FIG. 3 shows a perspective view of the toy stadium of FIG. 1 in a collapsed state.

FIG. 3 shows an exemplary collapsed state of the toy stadium of FIG. 1. When the screen 120 is at its critical position (120*c* of FIG. 2), the next impact of toy FIG. 170 on screen 120 causes the stadium 100 to collapse. The collapsed state may include, for example, multi-piece floor 115 having portions 116 and 117 of its floor tilting inward, light structure 140 having its upper half 142 splitting apart from its lower half 144, screen 120 collapsing past its critical position with its two halves 122 and 124 pivoting apart from each other, and audience stands 130 pivoting outward, away from the wrestling ring 100. Additional toy figures (not shown) that may be seated in the audience stands 130 may furthermore be ejected as the audience stands 130 pivot to their collapsed state. While the various components of stadium 100 are shown as pivotally or hingedly moving in FIG. 3, in other embodiments, the movable components may be otherwise displaced from each other, such as by a sliding or lateral movement, or rotational displacement.

To restore the stadium 100 to its initial assembled state, a user returns the screen to its beginning position. The audience stands and other movable components may be coupled to the screen in such a way that when a user returns the screen to its vertical position, all of the movable components are also returned to their initial positions. Thus, a user may resume another round of play quickly and easily. In other embodiments, the number of motions required to return the stadium 100 from its collapsed state to its initial state may be designed to require a minimal number of steps, such as at most two or at most three. For example, a two-step combination of moving the screen 120 and the audience stands 130 to their assembled positions may restore the floor portions and any other displaced components as well.

In another play mode, the user may swing the camera crane 150, which is mounted onto a wrestling ring post 112, to knock down the screen 120. The camera crane 150 may be used instead of or in addition to the toy FIG. 170 to impact and progressively tilt the screen 120, until screen 120 reaches its critical angle to collapse the stadium 100.

Figure 4A:
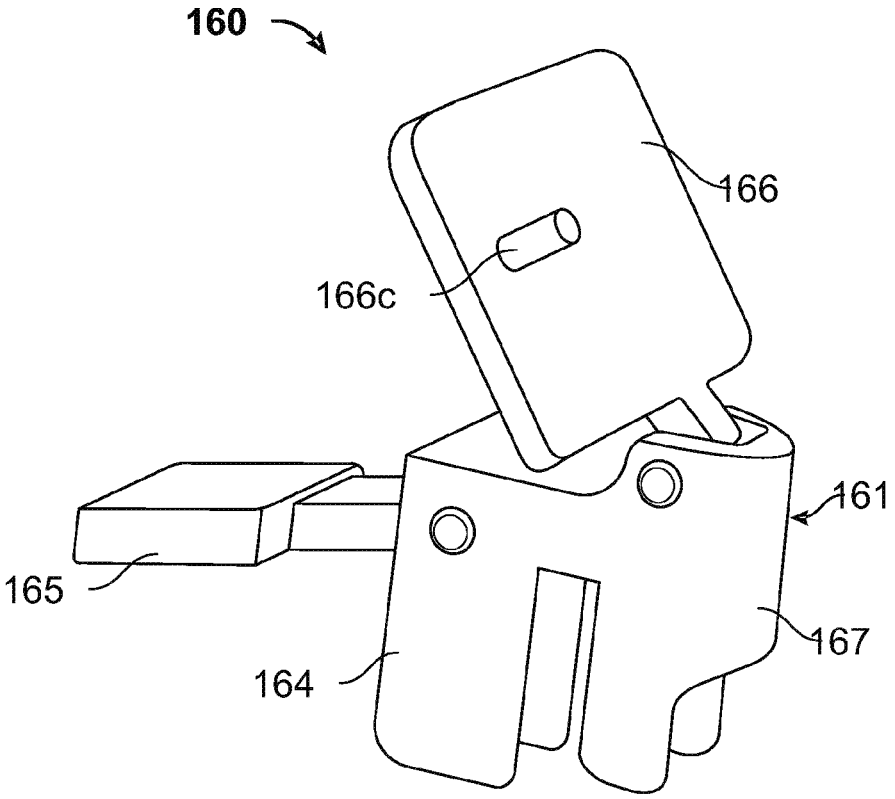
FIGS. 4A-4C provide perspective views of components of an exemplary launching platform.
Figure 4B:
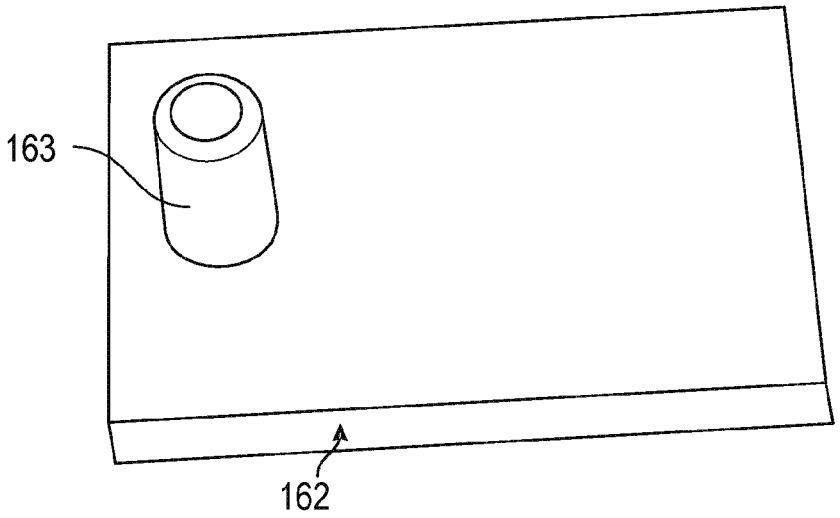
Figure 4C:
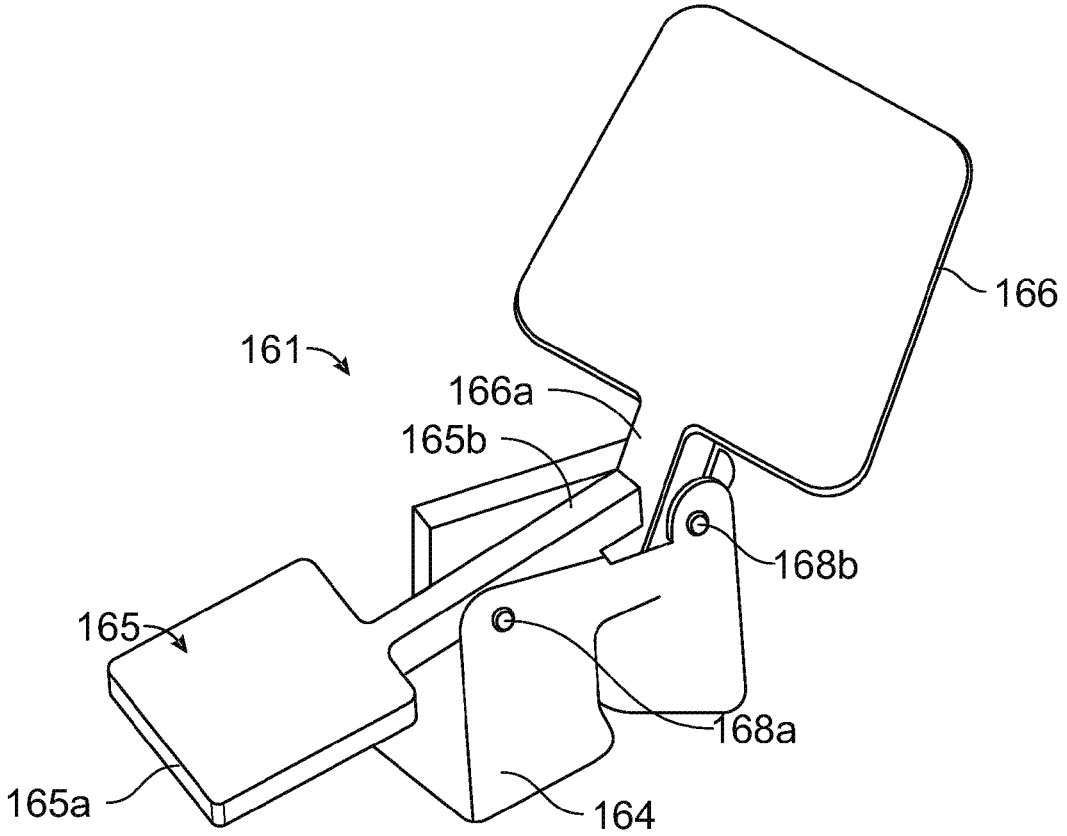

In the embodiment of FIG. 3, the launching platform 160 is mounted onto the wrestling ring 110 rather than being a separate component as in FIG. 1. FIGS. 4A-4C depict close-up views of a launching mechanism 161 and a base 162 of the launching platform 160. Base 162 includes a rod 163 protruding from its upper surface, onto which the launching mechanism 161 is mounted. Launching mechanism 161 includes a main body 164, a lever 165 pivotally coupled to main body 164, a platform 166 pivotally coupled to main body 162, and a tube 167 configured to be coupled to rod 163 of base 162. In this embodiment, the lever 165 and platform 166 are pivotally coupled to main body 164 using pin joints 168*a* and 168*b*, respectively, as shown in FIG. 4C. However, other joints are possible such as, but not limited to, hinges, ball joints, or the like. The tube 167 is configured to fit over post 162, so that launching mechanism 161 may be stabilized by base 162. Although tube 167 and post 163 are embodied here as cylindrical in shape, other cross-sectional shapes are possible.

In FIG. 4C, as a user presses down on the plate portion 165*a* of lever 165, the end of the lever arm 165*b* pushes upward on a tab portion 166*a* of platform 166, causing platform 166 to pivot and launch a toy figure. In yet further embodiments, lever 165 and platform 166 may be coupled together by, for example, spring-actuation, a mechanical lever, pneumatics, an electrical switch, or other means known in the art.

Figure 5:
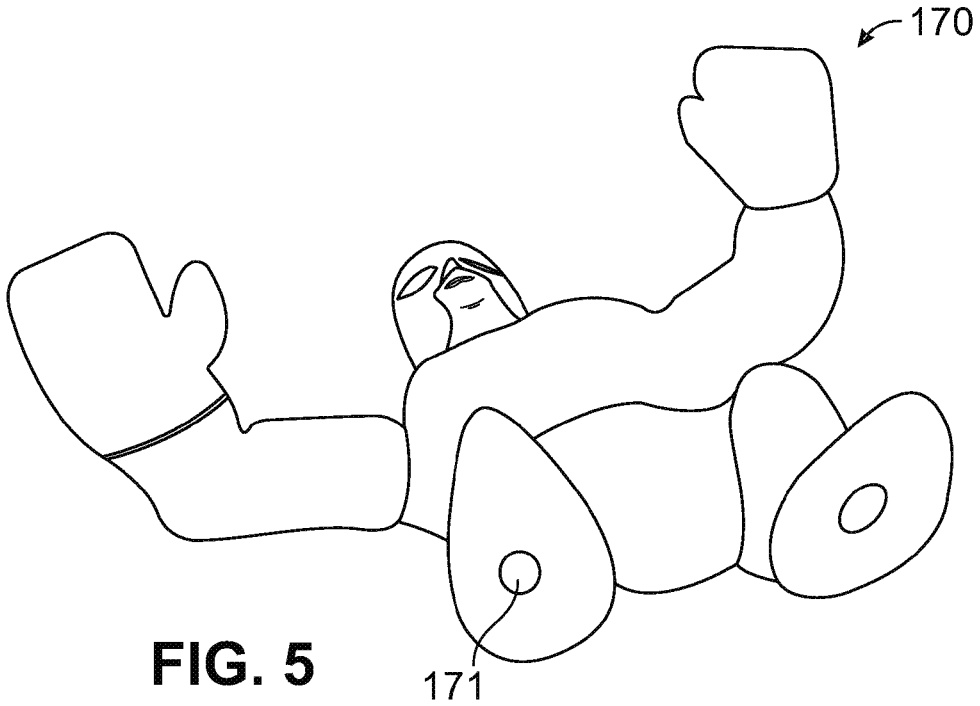
FIG. 5 shows a bottom view of a toy figure, in one embodiment.

Platform 166 may include a pin 166*c* protruding from its top surface, as shown in FIG. 4A, to assist in standing toy FIG. 170 on it. Toy FIG. 170 may be configured with a corresponding receiving hole 171, shown in FIG. 5, for mounting onto pin 166*c* of platform 166. In other embodiments, other features may be used for standing toy FIG. 170 on platform 166, such as a groove or slot to receive the base of the toy figure, or a support against which the toy figure can lean.

Figure 6A:
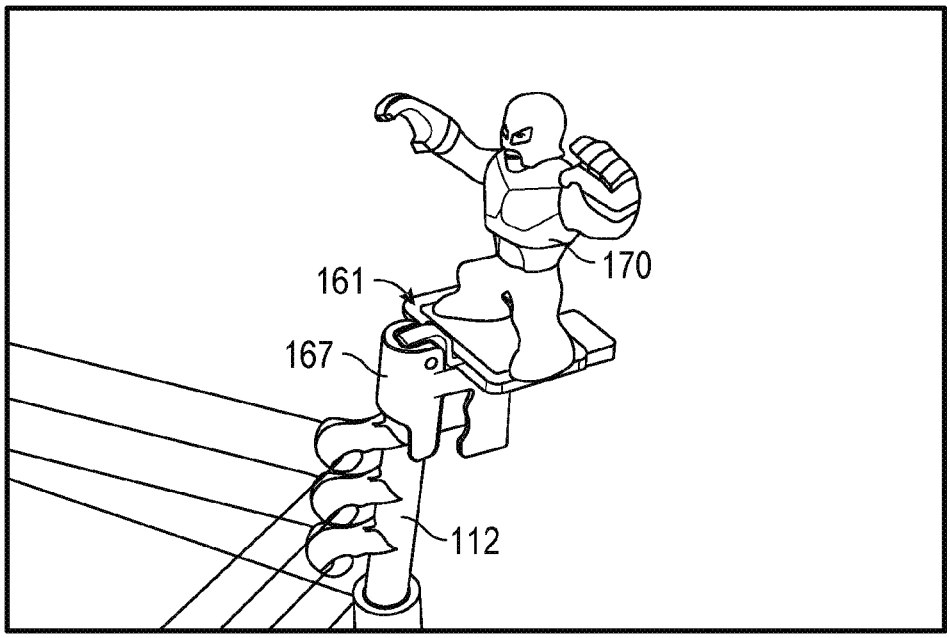
FIGS. 6A-6B are perspective views of a launching platform mounted to a post of a wrestling ring, in one embodiment.
Figure 6B:
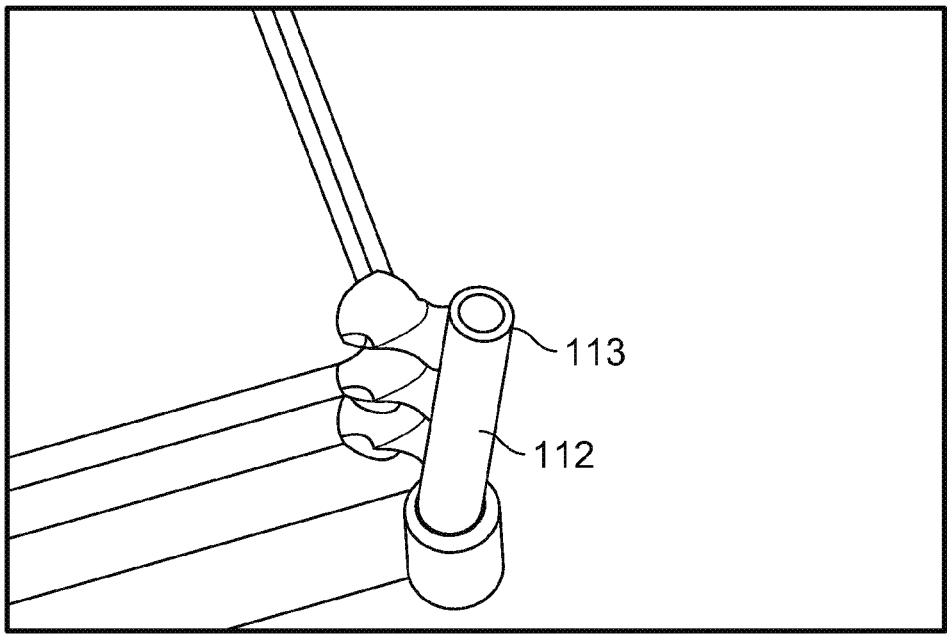

FIGS. 6A-6B show an embodiment in which the launching mechanism 161 is mounted to a post 112 of wrestling ring 110. The tube 167 of launching mechanism 161 fits over the top 113 of post 112. By being able to mount the launching mechanism 161 on any of the posts 112 of the wrestling ring 110, or to launching base 162, the user is able to aim the toy FIG. 170 from various angles as desired. This interchangeability in launching location adds the ability for more creative play.

Figure 7:
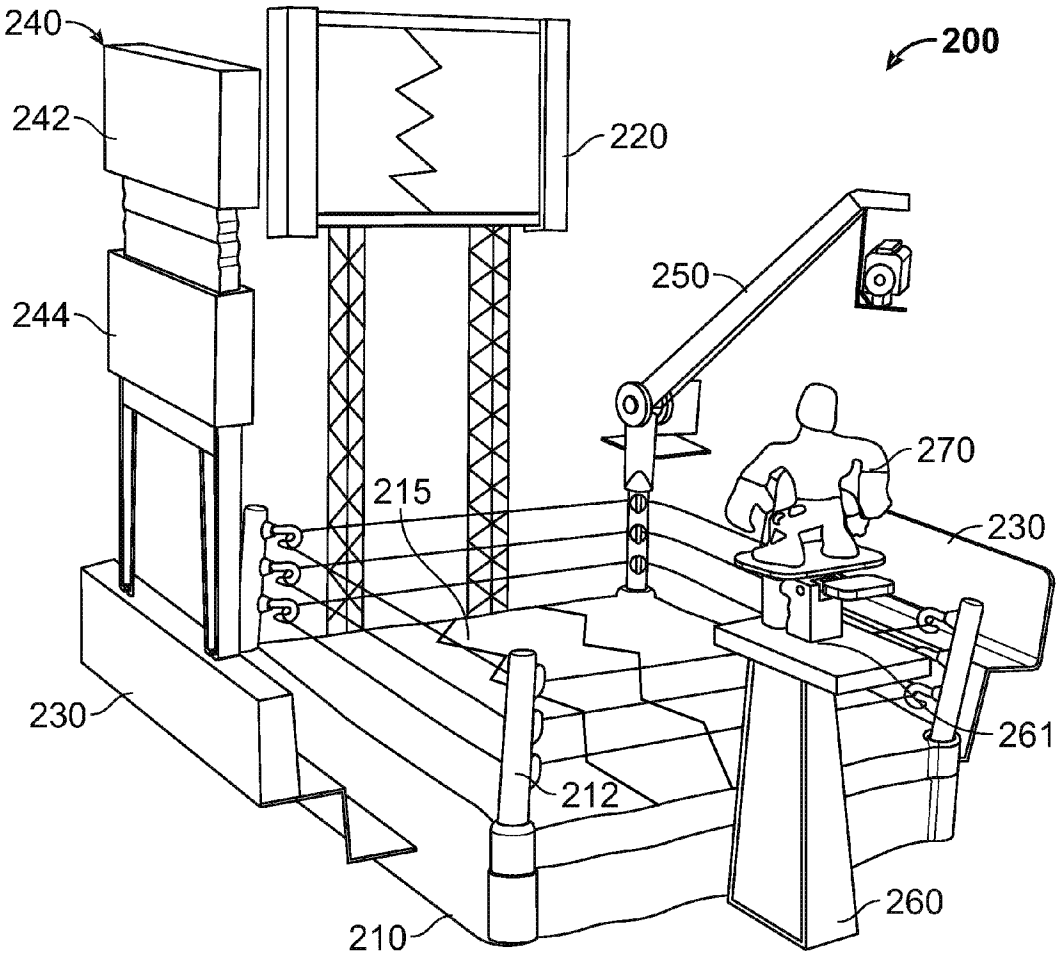
FIG. 7 is a perspective view of another embodiment of a toy stadium.

FIG. 7 is another illustration of an exemplary toy stadium 200, including a wrestling ring 210, a floor 215, a display screen 220, audience stands 230, a light structure 240, a camera crane 250, a launching platform 260 and a toy FIG. 270. In this embodiment, light structure 240 is embodied with upper and lower light panels 242 and 244 that are separable, rather than the support 142/144 portion of light structure 140 being separable as in FIG. 1. The audience stands 230 and floor 215 tilt when collapsed, similar to the collapsed state of stadium 100 in FIG. 3. Launching platform 260 is fixedly attached to wrestling ring 210 in this embodiment of FIG. 7, although launching mechanism 261 may be detachable from launching platform 260 to be mounted to a post 212 of the wrestling ring 210, as described in relation to FIGS. 6A-6B.

In further embodiments, a different portion of stadium 200 may serve as the target region instead of display screen 220. For example, the launching platform 260 may be configured in a location such that the target area may be the light structure 240 or audience stands 230. In another example, the launching platform 260 may be located above the other components, such as on top of light structure 240, and projectiles may be launched at the floor 215 of wrestling ring 210.

In the embodiments of FIG. 1 and FIG. 7, the floors 115 and 215 have three sections, with a central floor portion remaining intact. In other embodiments, a collapsible floor may be apportioned into any number, such as one or more, of floor portions that are separable from each other, with some or none of those floor portions remaining intact. Furthermore, the floor portions may become displaced in different ways, such as being tilted, rotated, detached, being ejected by a spring mechanism, or other. Having the components be displaced in various ways brings extra entertainment value to the user.

Figure 8:
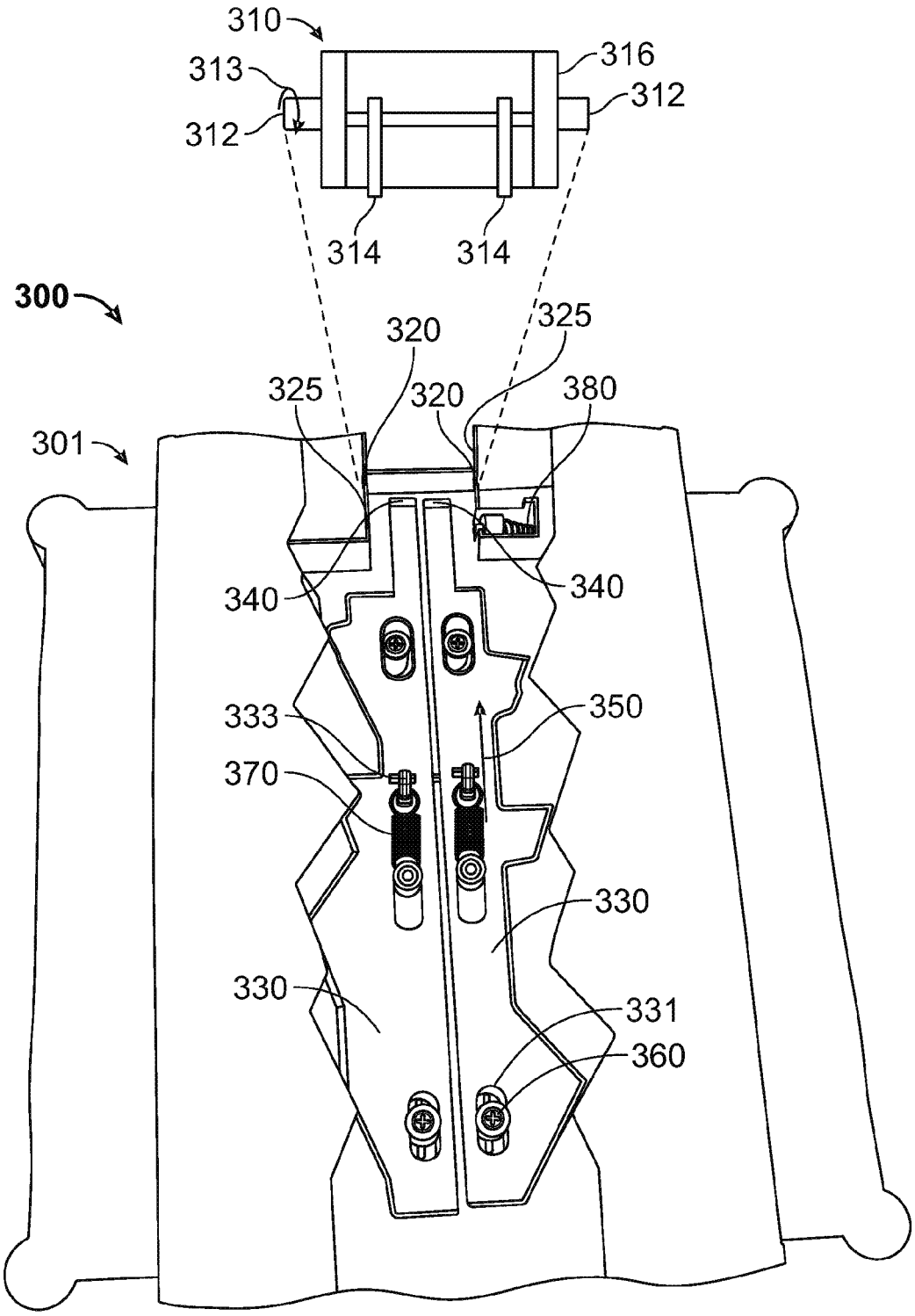
FIG. 8 depicts a bottom view of the exemplary wrestling ring of FIG. 1.

FIG. 8 shows the underside of a wrestling ring 300 in one embodiment, to illustrate an exemplary mechanism for achieving the delayed but sudden release of components in the toy stadium 100. The wrestling ring 300 includes a base 301 and an actuation element 310. Actuation element 310 includes pivot pins 312, teeth 314 and side surface 316. Teeth 314 serve as an engagement element to release the movable components of wrestling ring 300. In other embodiments, other engagement elements such as a pin, nub, or hook may be used.

Figure 9:
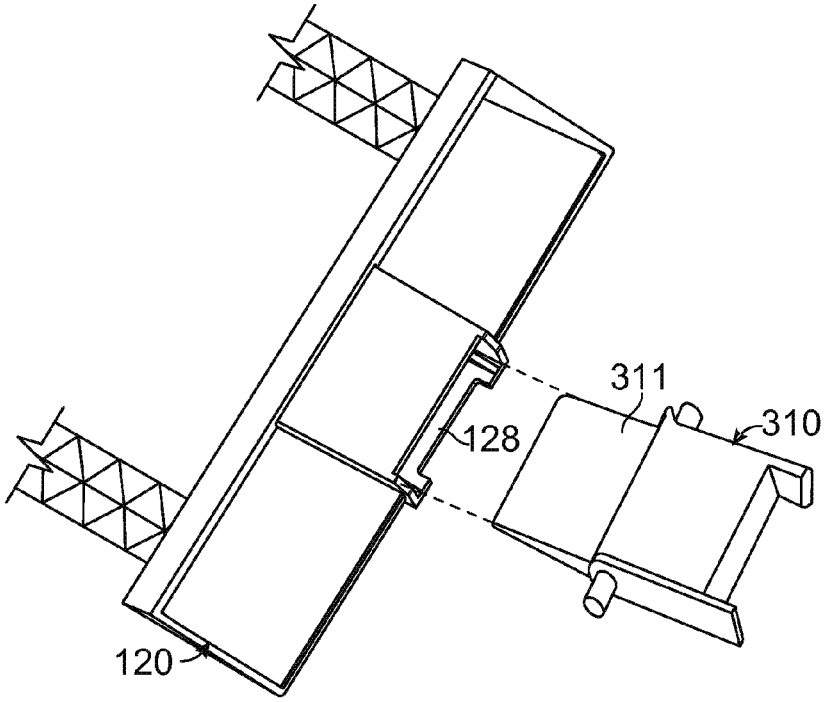
FIG. 9 shows an actuation element of FIG. 8 coupling to the screen base of FIG. 1, in one embodiment.

Actuation element 310 is coupled to screen 120, so that when the screen 120 is tilted, the actuation element 310 is rotated. For example, FIG. 9 illustrates one embodiment in which a slot 128 at the base of screen 120 slides over a receiving end 311 of actuation element 310 to couple screen 120 and actuation element 310 together. In other embodiments, screen 120 may be coupled to actuation element 310 with, for example, interlocking grooves and tabs, fasteners, or the like.

Returning to FIG. 8, pins 312 of actuation element 310 rest in U-shaped cutouts 320 in receiving walls 325 of base 301. Wrestling ring 300 has two sliding plates 330, each of which are used to release a floor section (e.g., 116 and 117 of FIG. 1). Each sliding plate 330 has a raised lip 340 at the end where actuation element 310 is mounted. As the actuation element 310 pivots in cutout 320, as indicated by arrow 313, teeth 314 pull the lips 340 in the direction shown by arrow 350. The sliding plates 330 may include slots 331 in which screws or posts 360 may be seated to slidingly secure the plates 330 to base 301. Springs 370 may be coupled to a hook 333 of sliding plate 330, to return the sliding plates 330 to their initial position.

Figure 10:
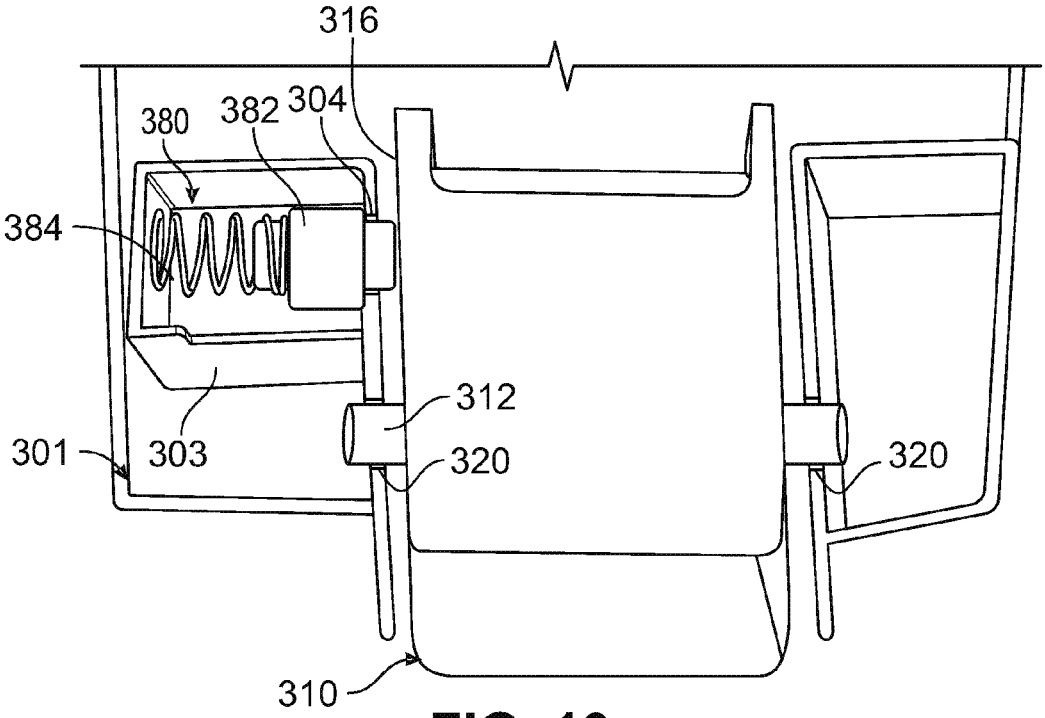
FIG. 10 provides a close-up bottom view of the area in which the actuation element in FIG. 8 is mounted.
Figure 11:
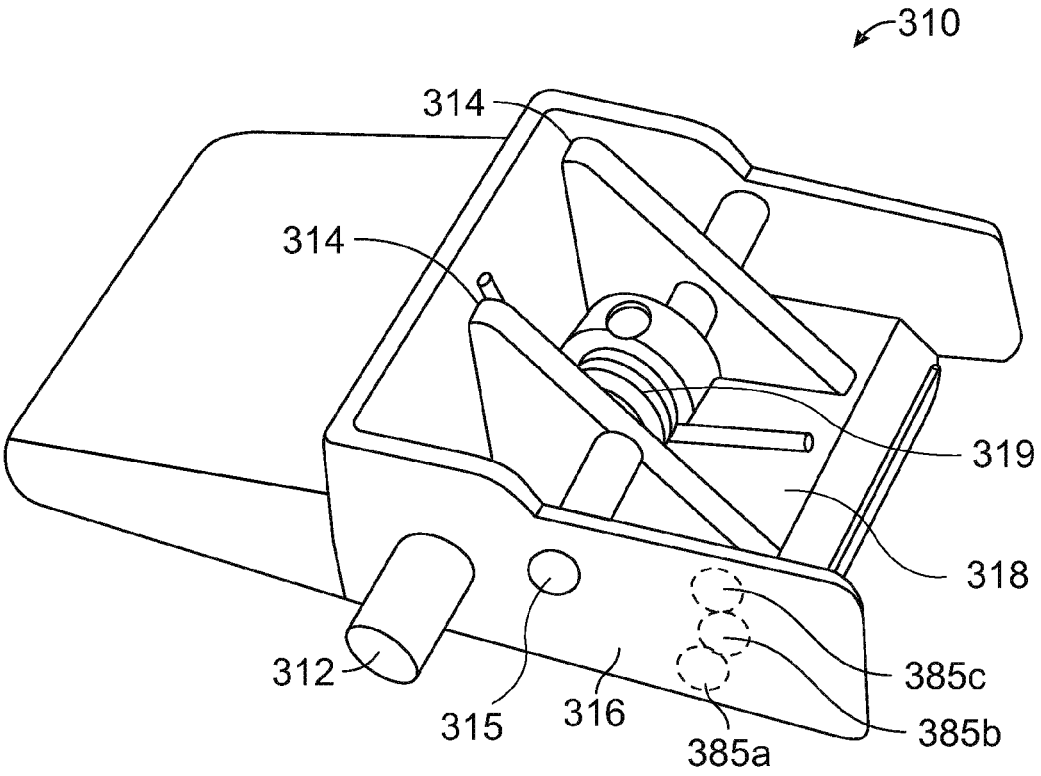
FIG. 11 is a side perspective view of the actuation element of FIG. 8.
Figure 12:
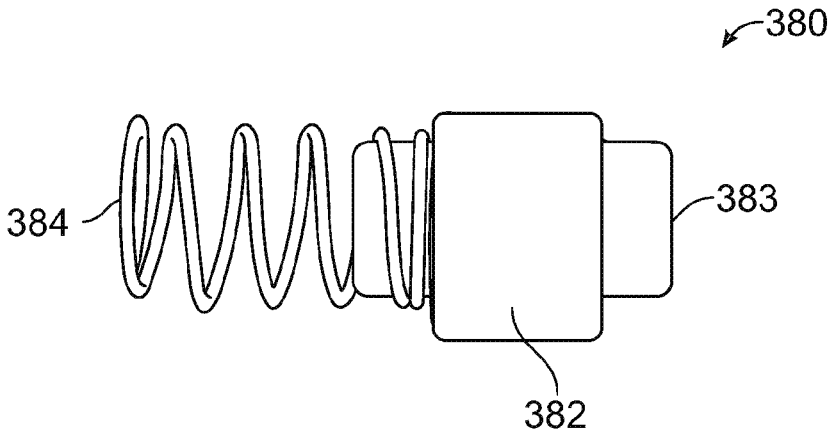
FIG. 12 is a top view of the resistance element of FIG. 8.

As the actuation element 310 rotates, due to screen 120 being impacted by a toy FIG. 170 or other object, a resistance assembly 380 presses against side surface 316 of actuation element 310. FIG. 10 shows a detailed view of the actuation element 310 and resistance element 380 as an assembly, while FIGS. 11 and 12 show close-up views of actuation element 310 and resistance assembly 380 as individual components. Resistance assembly 380 in FIG. 12 includes a plug 382 coupled to the end of a biasing element 384, such as a spring in this embodiment. Resistance element 380 is seated in a chamber 303 of base 301 (FIG. 10), with plug 382 extending through a cutout 304 of chamber 303. Plug 382 is made of a material, such as plastic, rubber or silicone, that imparts friction against side wall 316 as biasing element 384 pushes plug 382 against side surface 316. As actuation element 310 and screen 120 rotate, a top surface 383 of plug 382 (FIG. 12) presses against and moves along side surface 316 of actuation element 310, such as along positions 385*a*, 385*b*, and 385*c* as shown in FIG. 11. The friction between resistance element 380 and side surface 316 is able to hold screen 120 in intermediate positions when screen 120 is impacted, allowing the screen to progressively tilt until it reaches a critical point at which teeth 314 actuate the sliding plates 330. In FIG. 11, teeth 314 may be incorporated with a plate 318, where the teeth 314 and plate 318 rotate within actuation element 310 about a pin 315. This rotation allows teeth 314 to deflect and slide back over lips 340 (FIG. 8) when the screen 120 is returned to its initial position. A torsion spring 319 around pin 315 is biased such that teeth 314 are ready to engage lips 340 again after they have slid back in place.

Figure 13A:
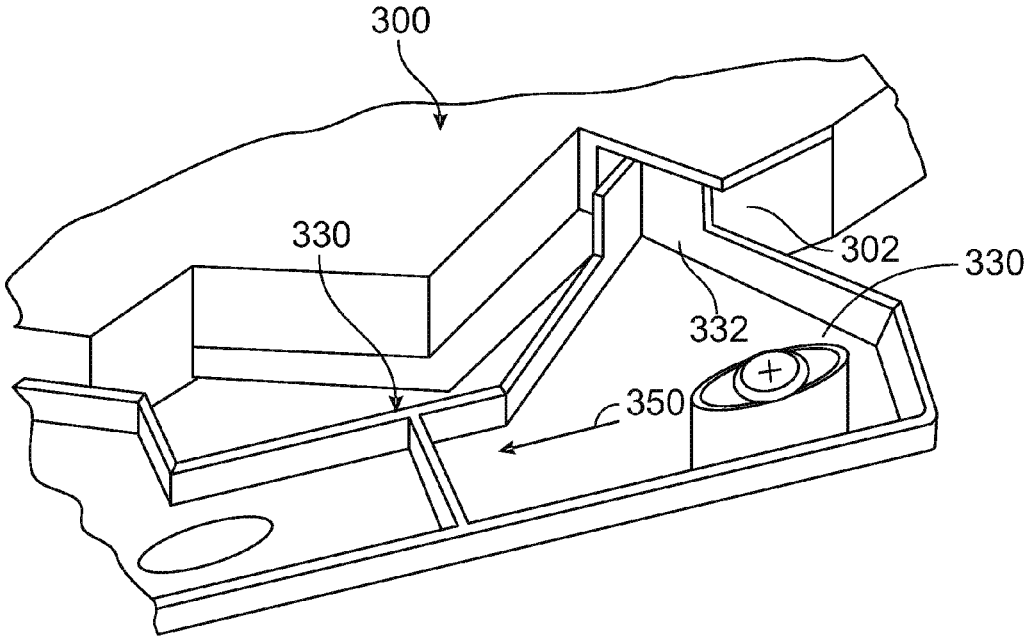
FIGS. 13A-13B are partial bottom views of exemplary sliding plates in the wrestling ring assembly of FIG. 8.
Figure 13B:
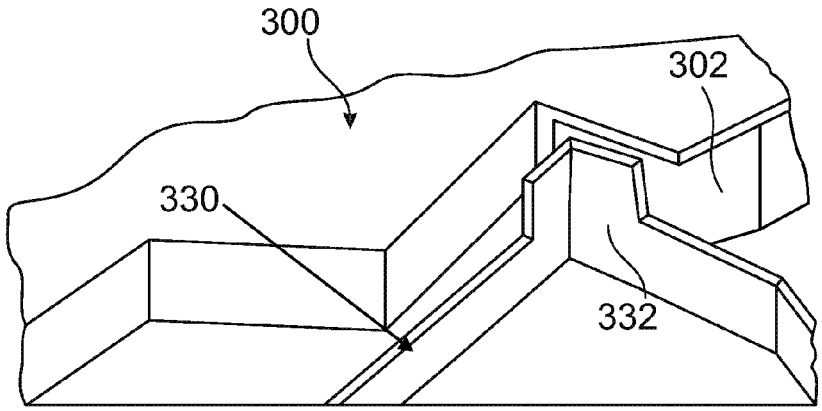

FIGS. 13A and 13B show detailed views of sliding plates 330, at the end region opposite of lips 340. In these views, a vertical tab 332 extends perpendicularly from sliding plate 330, where the shape of the tab 332 approximately matches the zigzag profile of plate 330 and slightly overlaps a gap 302 in the base of wrestling ring 300. As the sliding plate 330 is moved by the actuation element 310, the tab 332 is displaced to the left as shown by arrow 350. The displaced position is shown in FIG. 13B, where it can be seen that tab 332 has moved out of gap 302 and no longer supports the floor portion above tab 332. This displacement allows the floor portions (e.g., floor portions 116 and 117 of FIG. 1) to fall due to gravity, and thus collapse as shall be seen in FIG. 14. The displacement of the floor portions may cause other movable components of the structure to be displaced. For example, the tilting of floor portions 116 and 117 in FIG. 1, may consequently audience stands 130 to fall outward.

Figure 14:
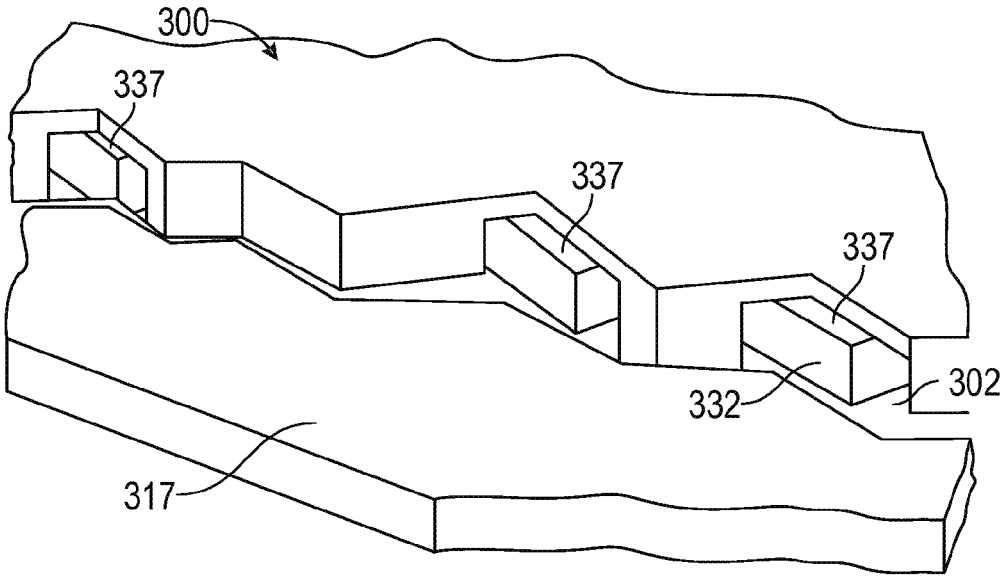
FIG. 14 shows a partial top view of the floor of FIG. 8 in a collapsed state.

FIG. 14 shows a top view of wrestling ring 300 with a floor portion 317 in a collapsed state. Tab 332 has a top edge 337 on which a floor portion 317 rests, when the wrestling ring 300 is intact. When the sliding plate 330 is displaced as described in FIGS. 13A-13B, the tab 332 is moved out of gap 302, thus no longer supporting floor portion 317 and allowing the floor portion 317 to fall inward.

In some embodiments, the ropes 114 of FIG. 1 may also contribute to creating a sudden collapse effect. Ropes 114 may be an elastic material and may be put under tension due to the spacing of wrestling ring posts 112. Because the ropes are coupled to the periphery of the floor portions 116 and 117, they apply a moment arm via the posts 112. When the floor portions 116 and 117 are released, the tension of ropes 114 can enhance the pivoting of the floor portions 116 and 117 by creating a sudden motion when the tension is released.

Figure 15:
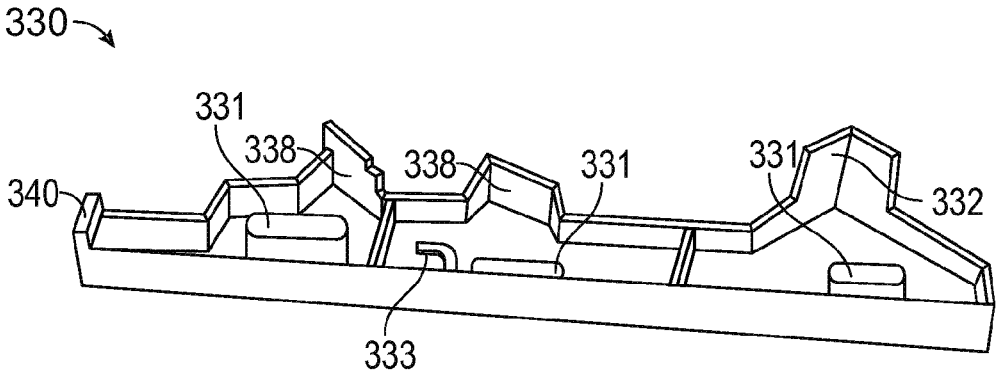
FIG. 15 shows a perspective view of a sliding plate from FIG. 8.

FIG. 15 shows the sliding plate 330 alone, showing lip 340, hook 333 and vertical tab 332. In this embodiment, vertical tab 332 has a height that extends the full gap 302 of FIG. 13A to provide stability to support the floor of the wrestling ring. Tabs 338 may be slightly shorter, as embodied here, to ease the slidability of plate 330.

Other mechanisms may be used to achieve the delayed but sudden release of components in the toy stadium 100 or 200. For example, in some embodiments the display screen may be mounted to a ratcheting gear which to serve as the resistance element, allowing for the progressive tilting of the screen. When the screen exceeds a predetermined tilt angle, the screen may contact a lever, push button, or other mechanism to release the ratcheting gear and the other movable components of the stadium so that all the components collapse as described above. Other resistance elements may include, for example, a stiff bellows which is able to hold intermediate positions as it extends, or telescoping components with a tight enough tolerance between the components that causes resistance to movement.

In other embodiments, the movable components may be coupled together at a common joint, or may be coupled to a screen release mechanism at various points through linkages. For example, the movable components may be hooked to a common linkage bar, where triggering of the screen displaces the bar and consequently releases all the movable components. In other embodiments, the movable components may be linked in series such as by levers, spring release mechanisms, or magnets. In such a serial configuration, when the screen releases one component—such as the wrestling ring floor—the remainder of the movable components collapse as well.

Note that while the figures in this application depict hinged or pivoting movements, other types of displacements are possible. For example, in some embodiments the screen and other movable components may undergo sliding or lateral movement. In an exemplary embodiment of a lateral movement, impacts on the display screen may slide the screen away from the wrestling ring, while the screen remains upright. When the screen reaches a certain distance away from the primary structure, a spring release or other triggering mechanism may be activated to release the movable components of the stadium. In yet another embodiment of various motions that may be achieved, a movable component may be constructed of multiple sub-components which are tethered together by a string or spring, where the sub-components are released—similar to a jack-in-the-box effect—when transformation of the toy apparatus is triggered.

After the collapsed state has been reached, the toy apparatus may be configured so that it may be easily restored to its original assembled state. In one embodiment, for example, a user may lift up on the audience stands, which pulls the remaining components to their initial positions. That is, not only are the movable components of the stadium coupled together to enable a simultaneous collapse, they are also coupled to enable a unified movement back to their assembled positions. Having the ability to restore the toy apparatus to its original state with one, two or very few motions beneficially allows the user to easily continue with play. This simplified reconstruction also reduces frustration compared to having to reassemble numerous separate components where individual components are disconnected and ejected away from each other. The movable components may be configured, for example, with a common linkage bar such that restoring one movable component pushes the linkage bar, which then consequently restores the remaining movable components to their assembled state. Other embodiments utilizing, for example, levers, tabs, springs, and other mechanisms are possible to restore the toy apparatus with a minimal number of steps.

In other embodiments, the toy stadium may be configured as other types of structures such as, for example, various sporting stadiums, a theater, an office building, a market, a transportation vehicle, or an alien city. In further embodiments, different objects may be used as projectiles to trigger the movement of the target region of the structure, as appropriate to the theme of the toy apparatus. For instance, play grocery items may be launched at a food display case in a market structure. In another example, weather elements such as simulated hail or lightning bolts may be aimed at a wall of an office building. In yet other exemplary embodiments, an arena may be provided with mobile vehicles such as cars, where the cars have sling shots, or other projectile launchers; a pond or other water body may be provided with boats, where the boats have cannons or other projectile launchers; or a jungle scene may have animals being launched to simulate jumping toward a target structure.

In yet further embodiments, the collapsed state may be a second transformed state of the assembly, rather than a destroyed, collapsed state. For example, a football stadium may have floor pieces with a football field depicted on one side and a soccer field on their backside. After reaching its critical transition point, such as by a scoreboard being repeatedly impacted by footballs, the floor pieces of the football stadium may flip upside down so that the structure transforms into a soccer stadium. In another example, a residential house may have walls, floor elements, shelving units, and other elements moved or displaced to transform the house into a headquarters for secret agents.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention.

What is claimed:

1. A toy apparatus comprising:

a primary structure having a plurality of components movably coupled together;

a target movably coupled to the primary structure; and a resistance element coupled to the target, the resistance element comprising:

a plug having a top first surface; and a biasing element coupled to the plug, the biasing element configured to place the first surface in contact with a second surface of the target, wherein the first surface holds the target using friction;

wherein the resistance element holds the target in a series of intermediate positions as the target progressively moves from an initial position to a critical position;

wherein the primary structure has an assembled state in which the plurality of components are coupled together, and the primary structure has a collapsed state in which the plurality of components are at least partially displaced from each other;

wherein repeated impacts on the target progressively moves the target from the initial position to the critical position; and wherein when the target reaches the critical position, the primary structure is released from the assembled state to the collapsed state.

2. The toy apparatus of claim 1, wherein the primary structure is a stadium and the target is a large screen display.

3. The toy apparatus of claim 1, wherein one of the plurality of components is a pivoting floor section, and wherein an elastic element is coupled around a periphery of the floor section and applies tension to cause the floor section to pivot when released to the collapsed state.

4. The toy apparatus of claim 1, wherein the critical position is a pre-determined angle of the target relative to the initial position, and wherein the target has a tilt angle that progressively increases from the initial position to the pre-determined angle.

5. The toy apparatus of claim 1, wherein the plurality of components are movably coupled such that restoring the target or one of the components from the collapsed state to the assembled state moves all of the plurality of components to the assembled state.

6. The toy apparatus of claim 1, wherein the plurality of components are movably coupled such that restoring the primary structure from the collapsed state to the assembled state requires at most two steps.

7. The toy apparatus of claim 1, further comprising a launching platform capable of launching projectiles to impact the target.

8. The toy apparatus of claim 1, further comprising an actuation element coupling the target to the plurality of components, wherein the actuation element releases the plurality of components when the target exceeds the critical position.

9. The toy apparatus of claim 8, wherein the second surface is on the actuation element.

10. The toy apparatus of claim 1, wherein the intermediate positions comprise the first surface of the plug being moved along the second surface as the target progressively moves from the initial position to the critical position.

11. The toy apparatus of claim 1, wherein the plug is coupled to an end of the biasing element.

12. A toy apparatus comprising:

a primary structure having a plurality of components movably coupled together;

a target movably coupled to the primary structure; and a resistance element coupled to the target, the resistance element comprising:

a plug having a top first surface; and a biasing element coupled to the plug, the biasing element configured to place the first surface in contact with a second surface of the target, wherein the first surface holds the target using friction;

wherein the resistance element holds the target in a series of intermediate position as the target progressively moves from an initial position to a critical position;

wherein the primary structure has a first state in which the plurality of components are coupled together, and the primary structure has a second state in which the plurality of components are at least partially displaced from each other;

wherein repeated impacts on the target progressively moves the target from the initial position to the critical position; and wherein when the target reaches the critical position, the primary structure is released from the first state to the second state.

13. The toy apparatus of claim 12, wherein the intermediate positions comprise the first surface of the plug being moved along the second surface as the target progressively moves from the initial position to the critical position.

14. The toy apparatus of claim 12, wherein the plurality of components are movably coupled such that restoring the primary structure from the second state to the first state requires at most two steps.

15. The toy apparatus of claim 12, further comprising a launching platform capable of launching projectiles to impact the target.

16. A method of constructing a collapsible toy apparatus, the method comprising:

movably coupling a plurality of components together to form a primary structure such that the primary structure has a first state and a second state, the components being at least partially displaced from each other in the second state;

movably coupling a target to the primary structure; and coupling a resistance element to the target, the resistance element comprising:

a plug having a top first surface; and a biasing element coupled to the plug, the biasing element configured to place the first surface in contact with a second surface of the target, wherein the first surface holds the target using friction;

wherein the resistance element holds the target in a series of intermediate positions as the target progressively moves from an initial position to a critical position;

wherein repeated impacts on the target progressively moves the target from the initial position to the critical position; and wherein when the target exceeds the critical position, the primary structure is released from the first state to the second state.

17. The method of claim 16, wherein the critical position is defined by a pre-determined angle of the target relative to the initial position of the target, and wherein the target has a tilt angle that progressively increases from the initial position to the pre-determined angle.

18. The method of claim 16, wherein the intermediate positions comprise the first surface of the plug being moved along the second surface as the target progressively moves from the initial position to the critical position.

* * * * *